US006963144B2

(12) United States Patent
Kurasawa et al.

(10) Patent No.: US 6,963,144 B2
(45) Date of Patent: Nov. 8, 2005

(54) STARTER HAVING PINION-ROTATION-RESTRICTING MEMBER FOR USE IN AUTOMOTIVE VEHICLE

(75) Inventors: Tadahiro Kurasawa, Chita-gun (JP); Tsutomu Shiga, Nukata-gun (JP); Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 147 days.

(21) Appl. No.: 10/701,487

(22) Filed: Nov. 6, 2003

(65) Prior Publication Data

US 2004/0108727 A1 Jun. 10, 2004

(30) Foreign Application Priority Data

Dec. 6, 2002 (JP) ..... 2002-355887

(51) Int. Cl.[7] ..... F02N 11/00
(52) U.S. Cl. ..... 290/38 R; 290/48; 74/7 A
(58) Field of Search ..... 290/38 R, 48, 290/31; 74/6, 7 R, 7 A

(56) References Cited

U.S. PATENT DOCUMENTS 2,727,158 A 12/1955 Seilly
5,443,553 A * 8/1995 Shiga et al. ..... 74/7 R
5,508,566 A * 4/1996 Nagao et al. ..... 290/38 R
5,621,249 A * 4/1997 Shiga et al. ..... 290/38 R
5,731,638 A 3/1998 Niimi
5,760,485 A * 6/1998 Shiga et al. ..... 290/38 R
5,789,821 A * 8/1998 Shiga et al. ..... 290/38 R
6,114,772 A 9/2000 Araki et al.
6,759,756 B2 * 7/2004 Shiga et al. ..... 290/38 R

FOREIGN PATENT DOCUMENTS

EP 0 911 516 A1 4/1999
GB 2 065 390 A 6/1981
JP A 09-217672 8/1997

* cited by examiner

*Primary Examiner*—Nicholas Ponomarenko
(74) *Attorney, Agent, or Firm*—Oliff & Berridge, PLC

(57) ABSTRACT

A pinion gear of a starter is engaged with a ring gear of an internal combustion engine by restricting rotation of the pinion gear while driving a motor at a low speed. After the engagement is established, the motor is driven at a full speed by supplying a full current, thereby cranking up the engine. After the engine is cranked up, the engagement between the pinion gear and the ring gear is released. In order to prevent the motor from being driven at the full speed before the pinion gear fully engages with the ring gear, rigidity of a crank bar for restricting the pinion rotation is made sufficiently high to generate a spring-load that exceeds a force for driving a plunger that closes a switch for supplying the full current.

5 Claims, 7 Drawing Sheets

FIG. 4A
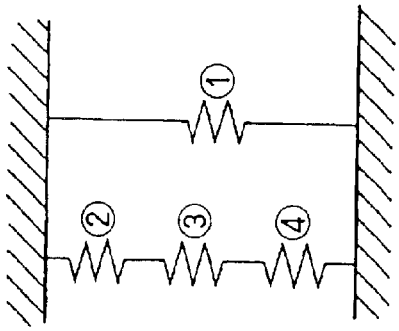
COMPOUND SPRING MODULUS k=0.87
FIG. 4B
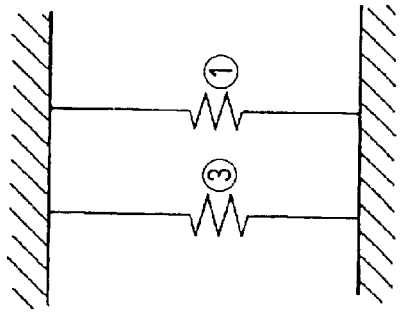
k=120.3
FIG. 4C
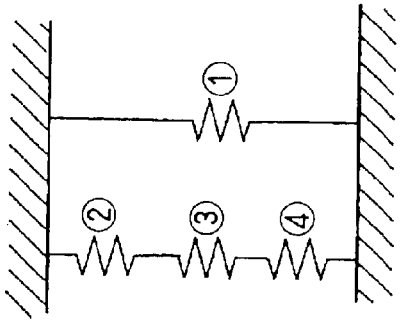
k=0.87
FIG. 4D
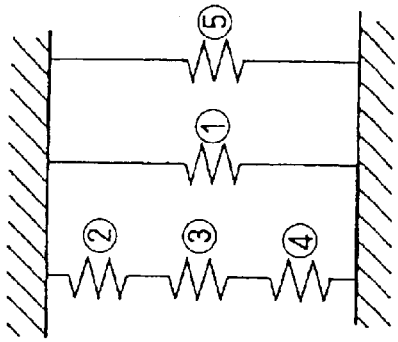
k=3.47
FIG. 4E
| No. | ① | ② | ③ | ④ | ⑤ |
|---|---|---|---|---|---|
| NAME OF SPRING | PLUNGER-RETURN SPRING | RETURN SPRING (39) | CRANK BAR (7) | PINION-ROTATION-RESTRICTING MEMBER (6) | CONTACT SPRING FOR SWITCH B |
| SPRING MODULUS | 0.3N/mm | 0.6N/mm | 120N/mm | 13N/mm | 2.6N/mm |

STARTER HAVING PINION-ROTATION-RESTRICTING MEMBER FOR USE IN AUTOMOTIVE VEHICLE

CROSS-REFERENCE TO RELATED APPLICATION

This application is based upon and claims benefit of priority of Japanese Patent Application No. 2002-355887 filed on Dec. 6, 2002, the content of which is incorporated herein by reference.

BACKGROUND OF THE INVENTION

1. Field of the Invention

The present invention relates to a starter for use in an automotive vehicle, the starter having a pinion-rotation-restricting member for engaging a pinion gear with a ring gear of an internal combustion engine.

2. Description of Related Art

An example of the starter of this kind is disclosed in JP-A-9-217672. In this starter, a pinion gear coupled to an output shaft of an electric motor by means of a helical spline is shifted toward a ring gear of an internal combustion engine while restricting rotation of the pinion gear. In this manner, the pinion gear engages with the ring gear of the engine, and the engine is cranked up by the electric motor. To reduce an impact generated at the engagement of the pinion gear with the ring gear, the motor is operated stepwise. That is, a small amount of current is supplied to the motor at the first step to thereby rotate a rotor at a low speed until the pinion gear engages with the ring gear. At the second step after the pinion gear engages with the ring gear, a full amount of current is supplied to the motor to crank up the engine. In other words, the motor rotates at a low speed until engagement between the pinion gear and the ring gear is established, and then the motor rotates at a full speed. This two-step operation is performed in response to a stroke of a plunger driven by a magnetic switch.

To perform the two-step operation without fail, it is necessary to make a spring-load of a member connecting the plunger to a member for restricting the pinion rotation larger than a magnetic force generated in the magnetic switch for driving the plunger. In the starter disclosed in JP-A-9-217672, the plunger and the restricting member are connected by a crank bar that has a resiliency in its rotational direction. Therefore, there is a possibility that the plunger is driven in a period after the pinion is restricted and before the pinion is fully engaged with the ring gear. If the plunger is driven in this period, the second step commences, thereby supplying full current to the motor. If this happens, the object of the two-step operation, i.e., reduction of the engagement impact, cannot be attained.

SUMMARY OF THE INVENTION

The present invention has been made in view of the above-mentioned problem, and an object of the present invention is to provide a starter having a member for restricting pinion rotation, in which the two-step operation for reducing the engagement impact is surely performed.

The starter includes an electric motor, a magnetic switch and a pinion gear driven by the electric motor. In the process of operating the starter, the magnetic switch is first energized by closing an ignition switch. A plunger in the magnetic switch is driven upon energization of the magnetic switch. In response to movement of the plunger, a first switch for supplying a small amount of current to the armature of the motor is closed. The armature rotates at a low speed upon closing the first switch. At the same time, the plunger drives a crank bar which in turn brings a pinion-rotation-restricting member into engagement with the pinion gear. Thus, the rotation of the pinion gear is restricted. The restricted pinion gear which is spline-coupled to an output shaft of the motor is pushed toward a ring gear of an internal combustion engine, thereby bringing the pinion gear into engagement with the ring gear. The restriction of the pinion gear commences after the first switch is closed and before the pinion gear starts to rotate.

After the pinion gear engages with the ring gear, the pinion gear is released from the restriction. The stroke of the plunger further proceeds, and a second switch for supplying a full current to the armature is closed. The armature rotates at a full speed, thereby cranking up the engine. After the engine is cranked up, the pinion gear is shifted back to its original position, disengaging with the ring gear. At the same time, current supply to the armature is terminated. Thus, the operating process of the starter is completed.

The starter is operated in two steps, as briefly described above. In the first step, the motor rotates at a low speed, and rotation of the pinion gear is restricted for a certain period during which the pinion gear is engaged with the ring gear. Then, in the second step, the motor rotates at a full speed to thereby crank up the engine. In order to carry out the two-step operation without fail, rigidity of the crank bar that drives the pinion-rotation-restricting member is set to such a level that a spring-load generated in the crank bar during the period in which the pinion gear is restricted exceeds the force for driving the plunger. In this manner, the plunger movement is temporarily halted, thereby preventing the second switch from being closed before the pinion gear fully engages with the ring gear.

A portion engaging with the pinion gear may be formed at an end of the pinion-rotation-restricting member, and the engaging portion may be directly pushed by the crank bar. The crank bar may be made to include a coupling end coupled to the plunger, an operating end for pushing the pinion-rotation-restricting member and a straight portion connecting both ends. The straight portion and both ends of the crank bar may be made integrally as a single body. Alternatively, either the coupling end or the operating end, or both ends may be separately made from the straight portion, and the separated end or ends may be connected to the straight portion after the separated end or ends are correctly coupled or positioned in the process of assembling the starter.

According to the present invention, the two-step operation is surely performed, and the engagement impact is reduced. Other objects and features of the present invention will become more readily apparent from a better understanding of the preferred embodiment described below with reference to the following drawings.

BRIEF DESCRIPTION OF THE DRAWINGS

FIGS. 4A–4D show working relations of various spring members at four positions in one stroke of a plunger driven by a magnetic switch and a compound spring modulus in each position;

FIG. 4E is a table showing the spring modulus for each spring member shown in FIGS. 4A–4D;

DETAILED DESCRIPTION OF THE PREFERRED EMBODIMENT

Figure 1:
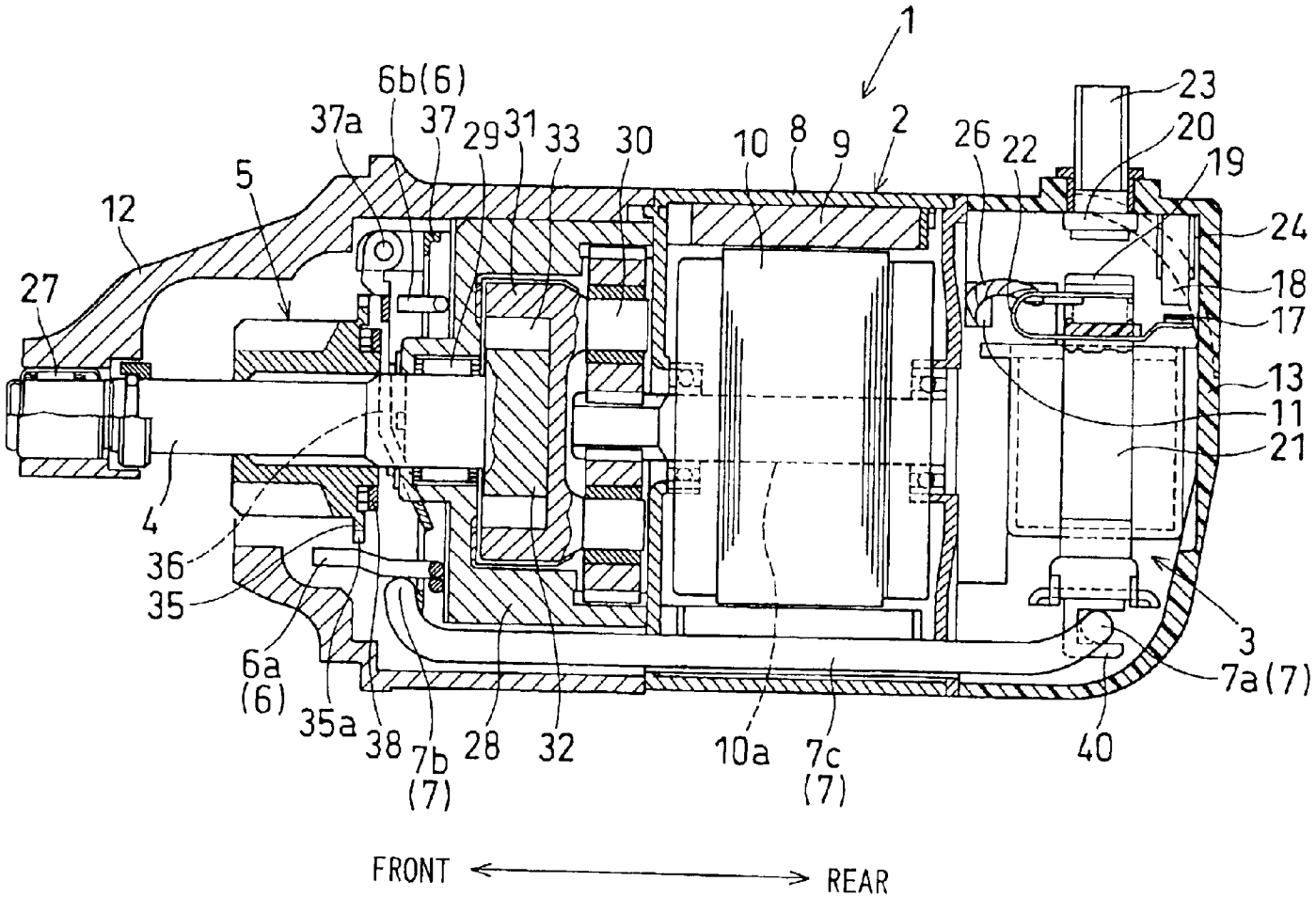
FIG. 1 is a cross-sectional view showing a starter according to the present invention.

A preferred embodiment of the present invention will be described with reference to FIGS. 1–7B. As shown in FIG. 1, a starter 1 of the present invention includes: an electric motor 2; a magnetic switch 3 for supplying current to the motor 2 in an on-and-off fashion; an output shaft 4 driven by the motor 2; a pinion gear 5 slidably coupled to the output shaft 4; a pinion-rotation-restricting member 6 that restricts rotation of the pinion gear 5 when the pinion engages with a ring gear of an internal combustion engine; a crank bar 7 that is driven by the magnetic switch 3 and pushes the pinion-rotation-restricting member 6 into an engagement position with the pinion gear 5; and other associated components.

Figure 2:
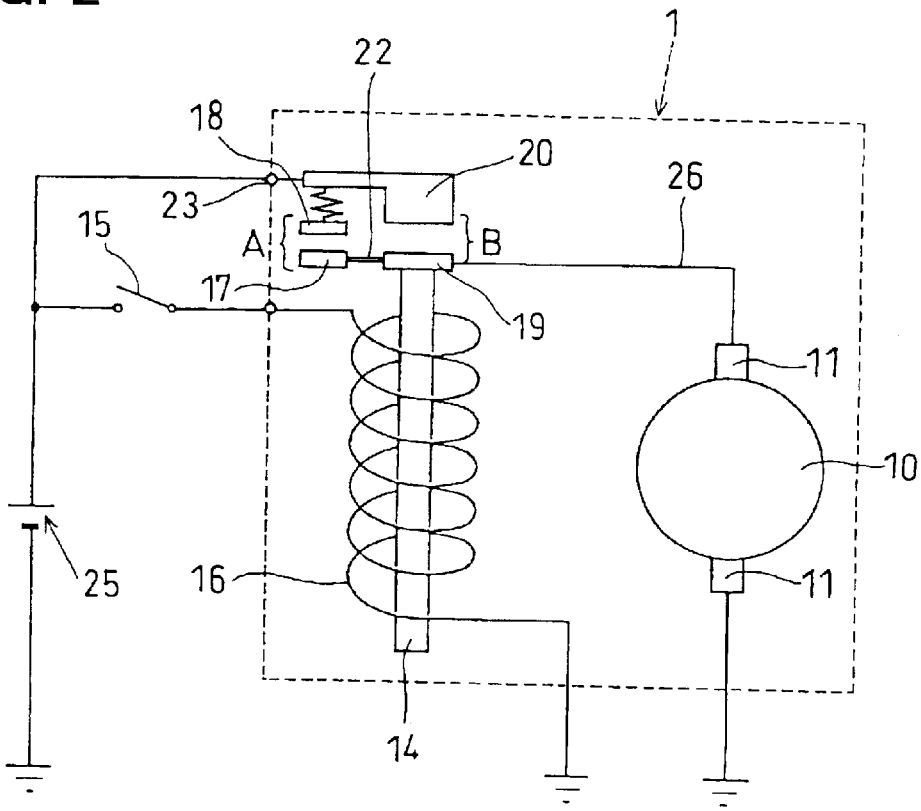
FIG. 2 is a circuit diagram showing electrical connections in the starter.

The electric motor 2 is a known type of a direct current motor that is electrically connected in the starter 1 as shown in FIG. 2. The motor 2 is composed of a yoke 8, poles 9 formed by permanent magnets, an armature 10, brushes 11 and other associated components. Upon closing motor contacts (in a manner explained below) by the magnetic switch 3, electric current is supplied from an on-board battery 25 to the armature 10 through the brushes 11, generating a rotational torque in the armature 10. The motor 2 is contained in a space confined by a front housing 12 and a rear end cover 13. The front side and the rear side of the starter 1 are shown in FIG. 1.

The magnetic switch 3 including a plunger 14 (shown in FIG. 2) that is driven in a direction perpendicular to an axial direction of the output shaft 4 is positioned at a rear side of the starter 1. As shown in FIGS. 1 and 2, the magnetic switch 3 is composed of: a solenoid 16 that is energized when current is supplied thereto from the on-board battery 25 by turning on an ignition switch 15; the plunger 14 disposed in an inner bore of the solenoid 16 so that the plunger 14 is driven upward upon energization of the solenoid 16; and a plunger-return spring (not shown) that biases the plunger 14 toward its initial position. Movable contacts of a first switch "A" and a second switch "B" are connected to the plunger 14, as shown in FIG. 2.

The first switch "A" is composed of a first movable contact 17 connected to the plunger 14 and a first stationary contact 18 supported on the rear end cover 13. When the first switch "A" is closed, a small amount of current is supplied from the on-board battery 25 to the armature 10 through the brushes 11. The second switch "B" is composed of a second movable contact 19 connected to the plunger 14 and a second stationary contact 20 supported by the rear end cover 13. When the second switch "B" is closed, a full amount of current is supplied to the armature 10.

As shown in FIG. 1, the first movable contact 17 is supported on a resilient copper plate 22 which is in turn connected to a holder 21 connected to the plunger 14. The first movable contact 17 moves together with the plunger 14. The resilient copper plate 22 provides a contact pressure when the first movable contact 17 contacts the first stationary contact 18. The first stationary contact 18 is electrically connected to a terminal bolt 23 fixed to the rear end cover 13 through a conductor plate 24. The first stationary contact 18 is made of a material such as carbon that has a higher electrical resistance than the second stationary contact 20. The terminal bolt 23 is connected to the on-board battery 25 through a battery cable, as shown in FIG. 2.

The second movable contact 19, which is electrically connected to the first movable contact 17 through a copper plate 22, is supported on the holder 21 with an insulator interposed. Also, the second movable contact 19 is electrically connected to the brush 11 (a plus side) through a lead wire 26. The second stationary contact 20 is formed integrally with the terminal bolt 23. The holder 21 is connected to the plunger 14 via a spring (not shown) that provides a contact pressure when the second movable contact 19 contacts the second stationary contact 20.

A distance between the first movable contact 17 and the first stationary contact 18 is made smaller than a distance between the second movable contact 19 and the second stationary contact 20, so that the first switch "A" is closed first and the second switch "B" next during one stroke of the plunger 14. Since the electrical resistance in the first switch "A" is higher than that of the second switch "B", a small amount of current is supplied to the armature 10 when the first switch is closed.

The output shaft 4 is disposed at the front side of the motor 2 coaxially with an armature shaft 10*a*. The output shaft 4 is rotatably supported by a bearing 27 fixed to the front housing 12 and another bearing 29 fixed to a center case 28. A rotational torque of the armature 10 is transferred to the output shaft 4 via a speed reduction device and a one-way clutch in a manner described below. The center case 28 is disposed inside the front housing 12 at the front side of the yoke 8, and the speed reduction device and the one-way clutch are disposed in the center case 28.

The speed reduction device is a known one that reduces a rotational speed of the armature 10 through planetary gears 30 orbiting around a center gear, and transfers the reduced speed to the output shaft 4 through the one-way clutch. The speed reduction device of this type is called a planetary gear speed reduction device. The one-way clutch is composed of a clutch outer 31 that is rotated by the rotational torque outputted from the speed reduction device, a clutch inner 32 connected to the output shaft 4, and rollers 33 disposed between the clutch outer 31 and the clutch inner 32. When the rotational speed of the clutch outer 31 is higher than that of the output shaft 4, the rotational torque of the armature 10 is transmitted to the output shaft 4. On the other hand, when the rotational speed of the output shaft 4 (i.e., the rotational speed of the clutch inner 32) becomes higher than that of the clutch outer 31 due to a rotational torque of the engine cranked up, transmission of the rotational torque from the output shaft 4 to the armature 10 is interrupted.

Helical splines are formed on the inner bore of the pinion gear 5 and the outer periphery of the output shaft 4, and the pinion gear 5 is slidably coupled to the output shaft 4 by the splines. The pinion gear 5 is always biased toward the rear side by a biasing spring (not shown). The pinion gear 5 includes a flange 35 formed at its rear side, and the flange 35 has a plural depressions 35*a* formed on the outer periphery thereof.

Figure 3:
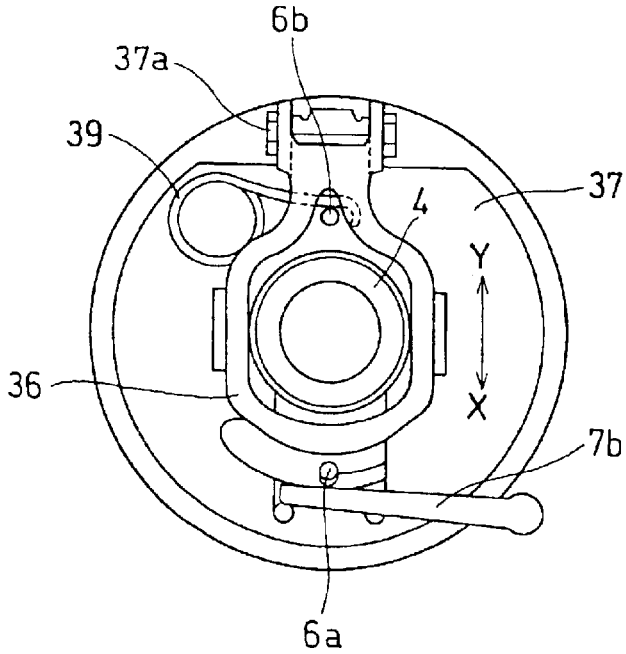
FIG. 3 is a plan view showing a ring for restricting a backward movement of a pinion and associated components, viewed from the front side of the starter.

At the rear side of the pinion gear 5, a ring 36, which prevents the pinion gear 5 from moving back toward the rear side in cooperation with the pinion-rotation-restricting member 6 after the pinion gear 5 is engaged with the ring gear, is disposed. The preventing ring 36, as shown in FIG. 3, includes an annular portion disposed outside of the output shaft 4. The preventing ring 36 is pivotally supported by a support 37*a* formed on a plate 37 and is connected to a thrust washer 38 disposed at the rear side of the flange 35. The plate 37 is positioned at a front side of the center case 28, thereby forming a space therebetween for accommodating the pinion-rotation-restricting member 6.

The pinion-rotation-restricting member 6 is formed by winding a metallic wire in a coil shape, for example, and is disposed in the space between the center case 28 and the plate 37. The pinion-rotation-restricting member 6 is disposed in the space so that it is movable in the direction X-Y shown in FIG. 3, while being always biased in direction X by a return spring 39. Both ends of the pinion-rotation-restricting member 6 are bent at a substantially right angle to the front side, as shown in FIG. 1, thereby forming an engaging portion 6*a* and an arm portion 6*b*. The engaging portion 6*a* engages with the depression 35*a* formed on the flange 35 when the pinion-rotation-restricting member 6 is moved upward, thereby restricting rotation of the pinion gear 5. The arm portion 6*b*, which is positioned opposite to the engaging portion 6*a* as shown in FIG. 3, engages with the return spring 39, thereby being biased downward.

The crank bar 7 is made of a metallic round rod, and its both ends are bent at a predetermined angle, forming a coupling end 7*a* and a operating end 7*b*. That is, the crank bar 7 is composed of a straight portion 7*c*, the coupling portion 7*a* and the operating portion 7*b*. As shown in FIG. 1, the coupling portion 7*a* engages with a hook 40 that is connected to the plunger 14, so that the stroke of the plunger 14 is transmitted to the crank bar 7. The straight portion 7*c* extends through a space between neighboring poles and disposed in parallel to the armature shaft 10*a*. The straight portion 7*c* is rotatably supported by a pair of bearings (not shown).

The operating portion 7*b* is initially positioned in contact with the engaging portion 6*a*, as shown in FIG. 1, and pushes upward the engaging portion 6*a* when the crank bar 7 is rotated by the plunger 14. The crank bar 7 has such a torsional rigidity that generates a spring-load higher than a force attracting the plunger 14 in the magnetic switch 3 during a period in which the pinion rotation is restricted. In this manner, the position of the plunger 14 in the magnetic switch 3, namely the plunger stroke, is kept unchanged during the period in which the pinion rotation is restricted.

Figure 5:
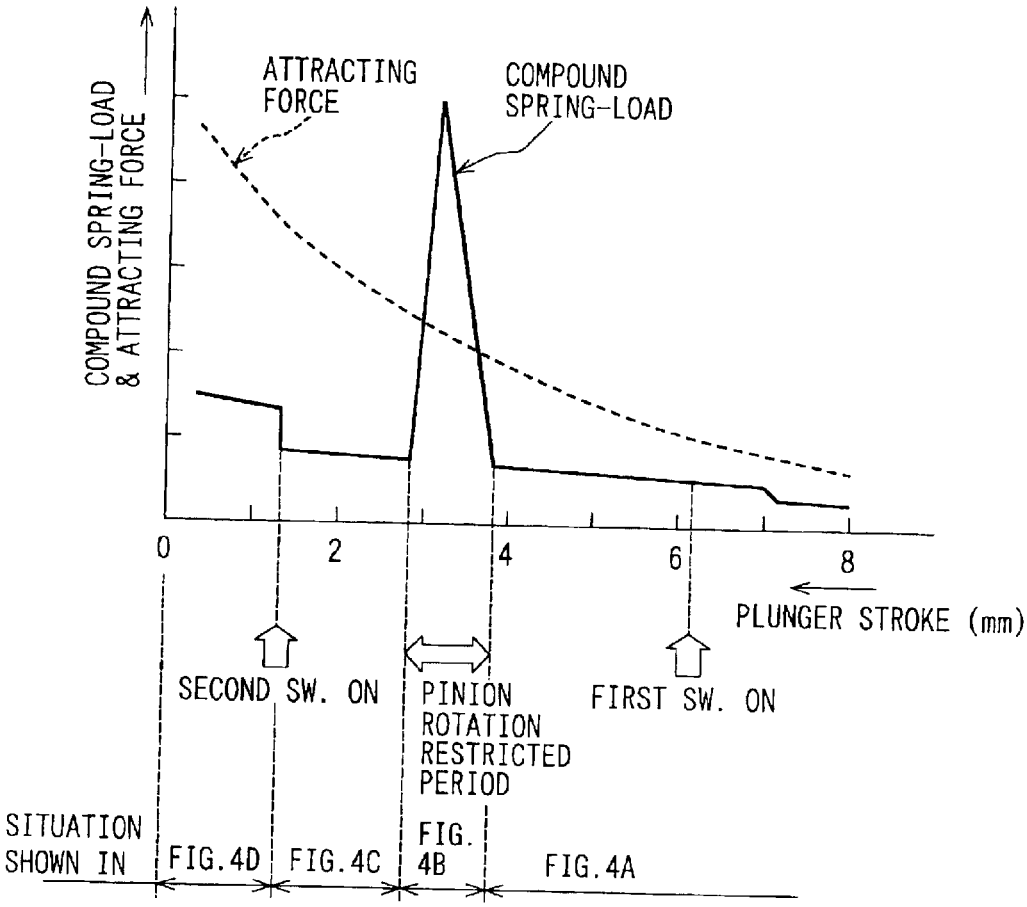
FIG. 5 is a graph comparing a magnetic force for attracting the plunger with a compound spring-load generated in the spring members during one stroke of the plunger.
Figure 6A:
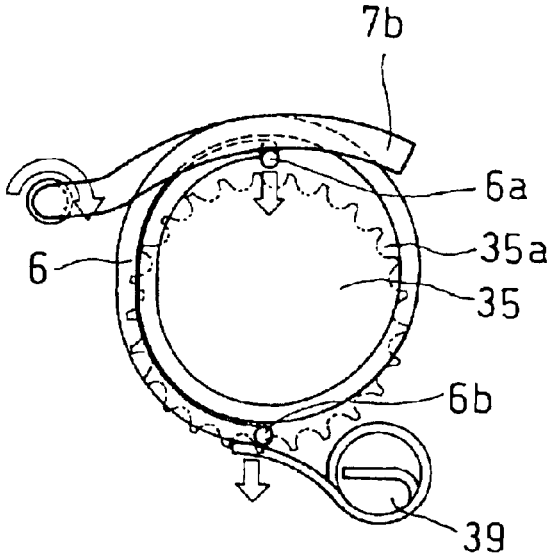
FIGS. 6A and 6B are drawings for explaining a position of a pinion-rotation-restricting member relative to a flange of a pinion gear before the pinion gear is restricted, FIG. 6A being an axial view and FIG. 6B a side view.
Figure 6B:
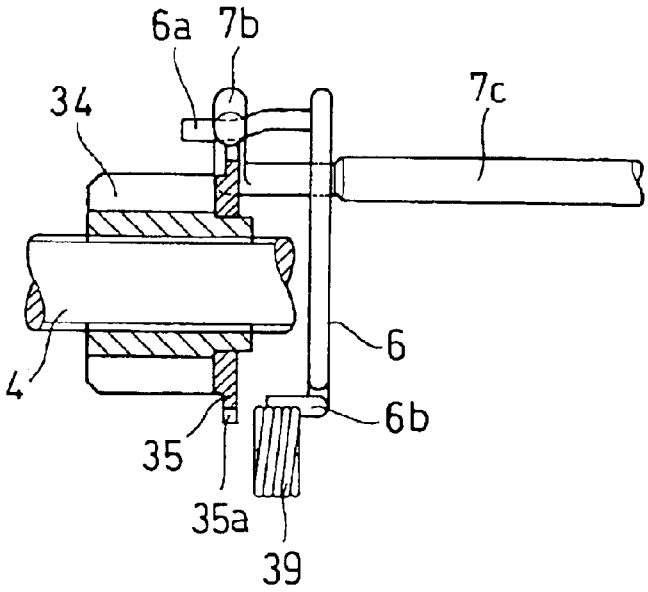
Figure 7A:
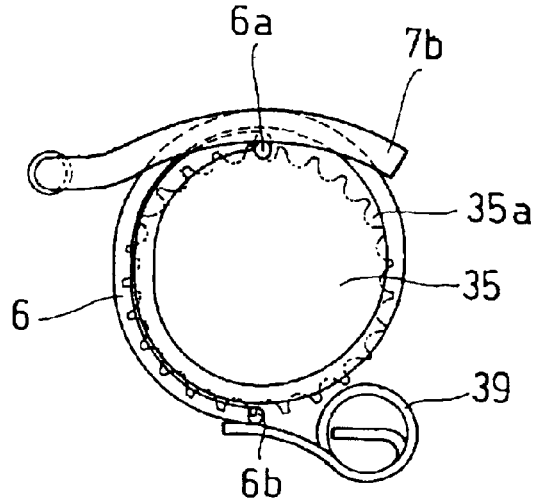
FIGS. 7A and 7B are drawings for explaining a position of the pinion-rotation-restricting member relative to the flange of the pinion gear after the pinion gear is restricted, FIG. 7A being an axial view and FIG. 7B a side view.
Figure 7B:
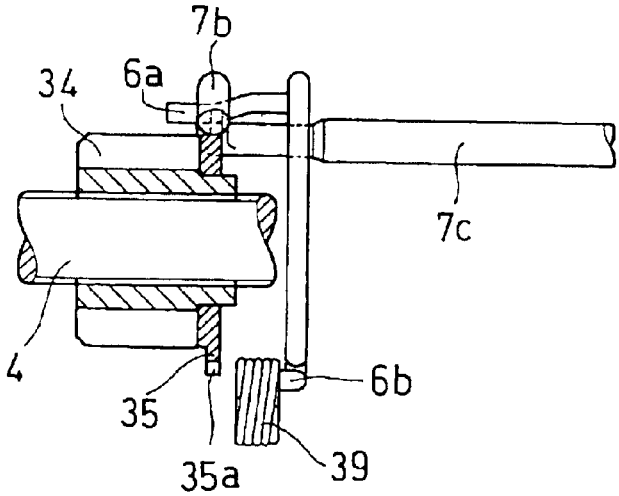

Now, operation of the starter 1 according to the present invention will be described with reference to FIGS. 4A–7B. In FIGS. 4A–4D, various spring members generating a compound spring-load at respective positions of the plunger 14 are shown: a spring member ① corresponds to a plunger-return spring (not shown in the drawings), a spring member ② to the return spring 39, a spring member ③ to the crank bar 7, a spring member ④ to the pinion-rotation-restricting member 6, and a spring member ⑤ to a contact pressure given to the second switch "B". In FIG. 4E, a spring modulus of each spring member ①–⑤ is shown. In FIG. 5, a comparison between the compound spring-load and the attracting force of the magnetic switch 3 is shown. In FIGS. 6A and 6B, a position of the pinion-rotation-restricting member 6 relative to the depressions 35*a* before their engagement is shown. In FIGS. 7A and 7B, its position after the engagement is established is shown.

Upon closing the ignition switch 15 (refer to FIG. 2), the solenoid 16 is energized. The plunger 14 is attracted into the magnetic switch 3 and moves upward, while compressing the spring member ①. The crank bar 7 is rotated in response to the upward movement (in FIG. 2) of the plunger 14. As the crank bar 7 rotates, the operating end 7*b* of the crank bar 7 pushes downward the engaging portion 6*a* of the pinion-rotation-restricting member 6 against the biasing force of the spring member ②, as shown in FIGS. 6A and 6B. Under this situation, the spring member ③ (corresponding to the crank bar 7) does not act as a spring because its spring modulus is extremely hither than those of the other spring members ①, ②, and ④. The spring member ③ only rotates according to the movement of the plunger 14. The compound spring modulus is 0.87 N/mm as shown in FIG. 4A. Because the attracting force of the magnetic switch 3 is much higher than the spring modulus of 0.87 N/mm, as shown in FIG. 5, the plunger 14 is attracted and moves upward (in FIG. 2), thereby closing the first switch "A". As a result, a small amount of current is supplied to the armature 10, thereby rotating the armature 10 at a low speed.

At the same time, the pinion-rotation-restricting member 6 is pushed downward, as shown in FIGS. 7A and 7B, and the engaging portion 6*a* is engaged with the depression 35*a*. Thus, the rotation of the pinion 5 is restricted, and the crank bar 7 becomes unable to rotate any more and acts as a torsion bar. At this moment, the spring modulus of the crank bar 7 becomes predominant, and the compound spring modulus becomes as high as 120.3 N/mm as shown in FIG. 4B. As a result, because the compound spring modulus exceeds the attracting force, as shown in FIG. 5, the movement of the plunger 14 is temporarily halted.

The pinion gear 5, the rotation of which is restricted, is pushed forward toward the ring gear along the helical spline of the output shaft 4 rotating slowly. When the pinion gear 5 is engaged with the ring gear, the engaging portion 6*a* is disengaged from the depression 35*a*. As a result, the restriction of the pinion gear 5 is released. When the pinion gear 5 is released from the restriction, the spring members ①–④ returns to the situation shown in FIG. 4C, which is the same as in FIG. 4A, showing the low compound spring modulus of 0.87 N/mm. Accordingly, the attracting force of the magnetic switch 3 becomes again higher than the compound spring modulus, as shown in FIG. 5. The plunger 14 resumes its movement, and thereby the second switch "B" is closed.

Upon closing the second switch "B", the spring member ⑤ generates a spring-load that gives a contact pressure to the second switch "B", as shown in FIG. 4D. Because the spring-load generated by the spring member ⑤ is small, the attracting force remains higher than the compound spring modulus. The plunger 14 is attracted to the end of its stroke (stroke=0 in FIG. 5). In this embodiment, the total stroke of the plunger 14 is set to 8 mm. The 8 mm stroke shown at the right end on the abscissa in FIG. 5 becomes zero at the left end of the abscissa according to the movement of the plunger 14. Upon closing the second switch "B", a full amount of current is supplied to the armature 10, and the engine is cranked up.

After the engine is cranked up, the ignition switch 15 is opened, and the solenoid 16 is deenergized. The plunger 14 returns to its original position by the biasing force of the plunger-return spring ①. As the plunger 14 moves to its original position, the crank bar 7 is rotated in the opposite direction and the pushing force of the operating end 7*b* applied to the engaging portion 6*a* is released. As a result, the pinion-rotation-restricting member 6 is pushed downward (in X direction in FIG. 3) by the return spring 39, and the engaging portion 6*a* becomes free from the preventing ring 36. The pinion 5 returns to its original position (the position shown in FIG. 1) by the biasing force of the pinion-return spring.

Since the spring-load exceeding the force attracting the plunger 14 is generated in the crank bar 7 during the period in which the rotation of the pinion gear 5 is restricted (the restricted period), the movement of the plunger 14 is brought to a halt during the restricted period while allowing the output shaft 4 to rotate at a low speed. Therefore, the two-step operation of the starter can be surely performed. In other words, the armature 10 is rotated at a low speed until the pinion gear 5 engages with the ring gear, and the armature 10 is rotated at a full speed, after the engagement is established, for cranking up the engine.

Since the engaging portion 6*a* of the pinion-rotation-restricting member 6 is directly pushed by the operating end 7*b* of the crank bar 7, the engaging portion 6*a* is firmly held between the depression 35*a* and the operating end 7*b* when the engaging portion 6*a* engages with the depression 35*a*. Therefore, the pinion-rotation-restricting member 6 is firmly held in the position. By employing this structure, it is not necessary to provide a stopper for prohibiting the movement of the pinion-rotation-restricting member 6 on the restricting ring 36. Accordingly, the structure of the preventing ring 36 can be simplified.

Figure 8A:
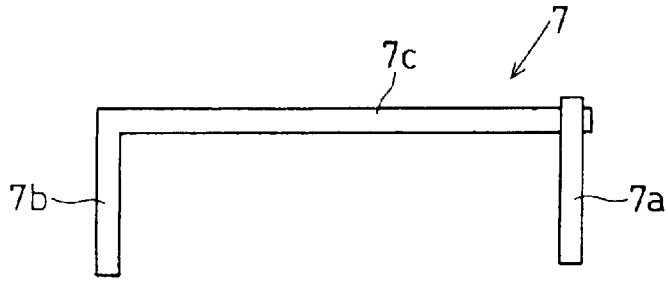
FIGS. 8A–8C are side views showing crank bars variously modified.
Figure 8B:
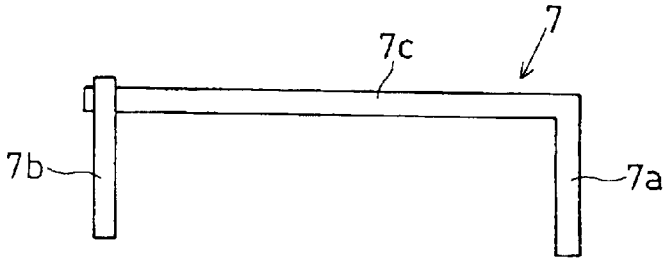
Figure 8C:
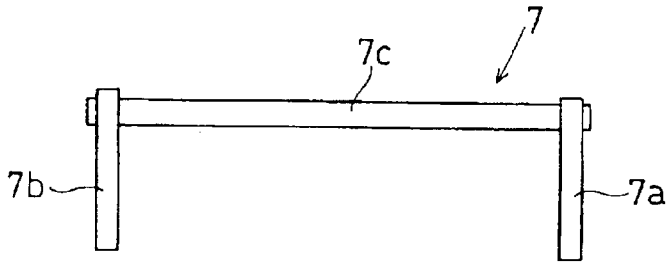
Figure 9:
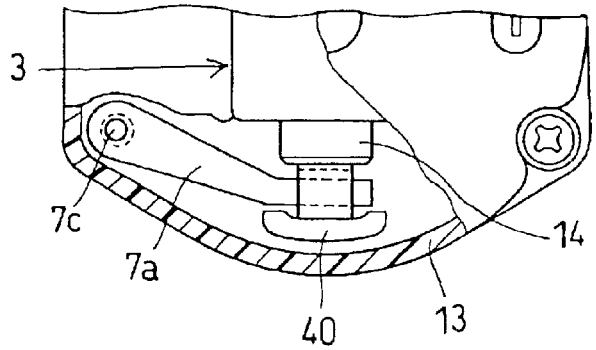
FIG. 9 is a partial cross-sectional view showing a coupling end of a crank bar coupled to a plunger hook, viewed from the rear side of the starter.

The crank bar 7 is formed as a single piece in the foregoing embodiment, but it may be assembled from separately formed components, as exemplified in FIGS. 8A–8C. In FIG. 8A, the coupling end 7*a* is formed separately from other portions of the crank bar 7. In FIG. 8B, the operating end 7*b* is separately formed. In FIG. 8C, both the coupling end 7*a* and the operating end 7*b* are formed separately from the straight portion 7*c*. When the coupling end 7*a* is separately formed, the coupling end 7*a* is first coupled to the hook 40 of the plunger 14 while adjusting the coupling angle therebetween, and then the straight portion 7*c* is connected to the coupling end 7*a*. The coupling end 7*a* coupled to the hook 40 is shown in FIG. 9. When the operating end 7*b* is separately formed, the position of the operating end 7*b* relative to the engaging portion 6*a* is first adjusted, and then the straight portion 7*c* is connected to the operating end 7*b*. In this manner, accuracy of the period in which the rotation of the pinion gear 5 is restricted can be improved without worrying too much about accuracy of the mounting positions of other parts such as the magnetic switch 3. At the same time, the cost for assembling the starter 1 can be reduced.

The present invention is not limited to the embodiment described above, but it may be variously modified. For example, the mechanical switches "A" and "B" used in the foregoing embodiment may be replaced with semiconductor switches. Though the pinion-rotation-restricting member 6 is operated by directly pushing the engaging portion 6*a* by the operating end 7*b* in the foregoing embodiment, it is also possible to operate the pinion-rotation-restricting member 6 by engaging the operating end 7*b* with the arm portion 6*b* in the same manner as disclosed in JP-A-9-217672 which is referred to in the Related Art section. In this case, however, it is necessary to prevent the pinion-rotation-restricting member from being distorted during the period in which the pinion rotation is restricted. More particularly, such distortion may be prevented by providing a stopper for supporting the arm portion 6*b* on the restricting ring 36.

While the present invention has been shown and described with reference to the foregoing preferred embodiment, it will be apparent to those skilled in the art that changes in form and detail may be made therein without departing from the scope of the invention as defined in the appended claims.

What is claimed is:

1. A starter for cranking an internal combustion engine having a ring gear, the starter comprising:

an electric motor;

a magnetic switch for driving a plunger by magnetic force generated therein;

a first switch operated by the plunger, the first switch being closed when the plunger is driven by a first predetermined stroke, thereby supplying a first amount of current to the electric motor;

a second switch operated by the plunger, the second switch being closed when the plunger is driven by a second stroke which is larger than the first stroke, thereby supplying a second amount of current which is larger than the first amount of current to the electric motor;

an output shaft driven by the electric motor;

a pinion gear coupled to the output shaft by means of a helical spline;

a pinion-rotation-restricting member adapted to engage with the pinion gear to restrict rotation of the pinion gear; and a crank bar rotatively driven by the plunger for bringing the pinion-rotation-restricting member into engagement with the pinion gear, thereby thrusting the pinion gear on the output shaft toward the ring gear of the internal combustion engine and establishing engagement between the pinion gear and the ring gear, wherein:

the crank bar driven by the plunger generates a spring-load which is higher than the magnetic force of the magnetic switch for driving the plunger during a period in which rotation of the pinion gear is restricted.

2. The starter as in claim 1, wherein:

the crank bar includes an operating end, the pinion-rotation-restricting member includes an engaging portion, and the operating end directly pushes the engaging portion for restricting rotation of the pinion gear.

3. The starter as in claim 1, wherein:

rotation of the pinion gear is restricted after the first switch is closed and before the pinion starts to rotate.

4. The starter as in claim 1, wherein:

the crank bar is composed of a straight portion, a coupling end coupled to the plunger and an operating end for pushing the pinion-rotation-restricting member, the coupling and operating ends being bent crank-wise from the straight portion.

5. The starter as in claim 4, wherein:

either the coupling end or the operating end, or both ends of the crank bar are formed separately from the straight portion, and the separately formed end or ends are connected to the straight portion after the separately formed end or ends are correctly positioned in the starter.

* * * * *